US007091712B2

(12) United States Patent
Miller et al.

(10) Patent No.: US 7,091,712 B2
(45) Date of Patent: Aug. 15, 2006

(54) CIRCUIT FOR PERFORMING VOLTAGE REGULATION

(75) Inventors: Ira G. Miller, Tempe, AZ (US); Brett J. Thompsen, Dallas, TX (US); Eduardo Velarde, Jr., Chandler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 182 days.

(21) Appl. No.: 10/843,805

(22) Filed: May 12, 2004

(65) Prior Publication Data

US 2005/0253570 A1 Nov. 17, 2005

(51) Int. Cl.
*G05F 1/567* (2006.01)

(52) U.S. Cl. ..... 323/312; 323/313

(58) Field of Classification Search ..... 323/312, 323/313, 314, 315, 907; 327/907
See application file for complete search history.

(56) References Cited

U.S. PATENT DOCUMENTS 4,342,926 A * 8/1982 Whatley ..... 327/541
5,859,560 A * 1/1999 Matthews ..... 327/513
5,910,749 A * 6/1999 Kimura ..... 327/541
6,351,111 B1 * 2/2002 Laraia ..... 323/315

OTHER PUBLICATIONS

Doyle, A CMOS Subbandgap Reference Circuit With 1-V Power Supply Voltage, IEEE Journal of Solid-State Circuits, vol. 39, No. 1, Jan. 2004, pp. 252-255.
Buck, "A CMOS Bandgap Reference Without Resistors," IEEE Journal of Solid-State Circuits, vol. 37, No. 1, Jan. 2002, pp. 81-83.
Banba, "A CMOS Bandgap Reference Circuit with Sub-1-V Operation," IEEE Journal of Solid-State Circuits vol. 34, No. 5, May 1999, pp. 670-673.

* cited by examiner

*Primary Examiner*—David M. Gray
*Assistant Examiner*—Richard V. Muralidar
(74) *Attorney, Agent, or Firm*—Susan C. Hill; James L. Clingan, Jr.

(57) ABSTRACT

A circuit (10, 100) is used to perform voltage regulation. In one embodiment, a voltage regulator (11) is used in conjunction with an output transistor (24) to form a circuit (10) which operates to regulate the voltage drop from a first node (30) to a second node (28). This second node (28) may be used to provide power to circuitry (27). The areas of several transistors (20–25) in circuit (10) may be adjusted so that negative and positive temperature coefficients may be balanced such that the circuit (10) behaves as desired over a range of voltages and temperatures. Note that in one embodiment, circuit (10) is a 2-terminal device.

21 Claims, 3 Drawing Sheets

CIRCUIT FOR PERFORMING VOLTAGE REGULATION

FIELD OF THE INVENTION

The present invention relates generally to a circuit, and more particularly to a circuit for performing voltage regulation.

RELATED ART

As the operating voltage of electronic circuitry is reduced due to increases in layout density, there are an increasing number of applications in which the power supply voltage remains the same but the operating voltage of the electronic circuitry must be lowered. However, as more and more applications rely on battery power, the power utilized by electronic circuitry must also be lowered. Thus there is a need for a circuit that can perform voltage regulation using as little power as possible.

BRIEF DESCRIPTION OF THE DRAWINGS

The present invention is illustrated by way of example and not limited by the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION

Figure 1:
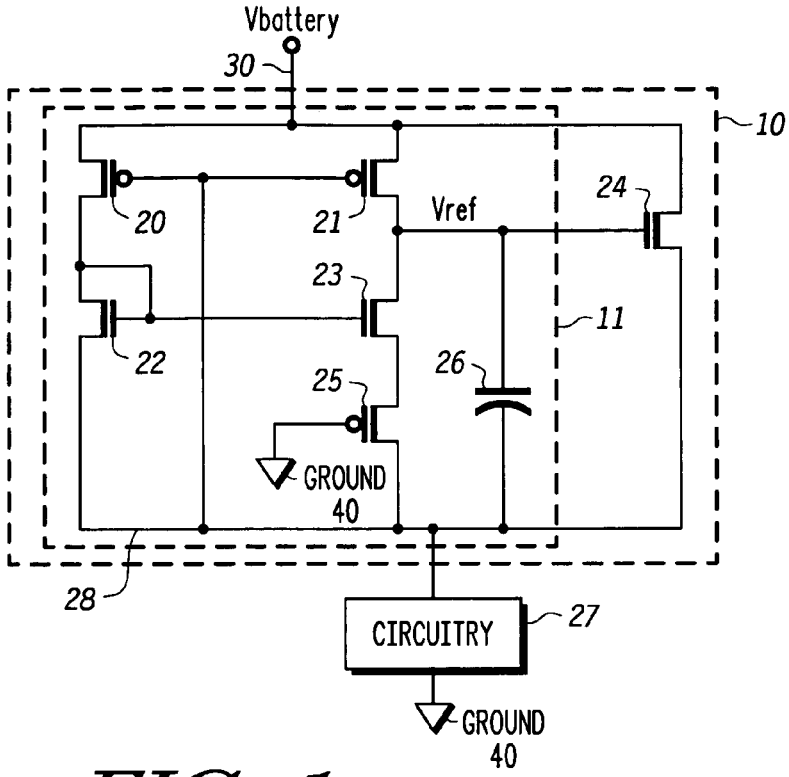
FIG. 1 illustrates, in schematic diagram form, a circuit in accordance with one embodiment of the present invention.

FIG. 1 illustrates, in schematic diagram form, a circuit 10 in accordance with one embodiment of the present invention which includes field effect transistors 20–25. A first terminal of circuit 10 is coupled to node 30 and a second terminal of circuit 10 is coupled to node 28. A first power supply voltage (e.g. Vbattery) is coupled to node 30 and circuitry 27 is coupled to node 28. Circuitry 27 is also coupled to a second power supply voltage 40 (e.g. ground). A first current electrode of p-channel transistor 20, a first current electrode of p-channel transistor 21, and a first current electrode of n-channel transistor 24 are all coupled to node 30. A control electrode of transistor 20 and a control electrode of transistor 21 are both coupled to node 28. A second current electrode of transistor 20 is coupled to a first current electrode of n-channel transistor 22, to a control electrode of transistor 22, and to a control electrode of n-channel transistor 23. A second current electrode of transistor 21 is coupled to a first current electrode of transistor 23, to a control electrode of n-channel transistor 24, and to a first terminal of a capacitive element 26. A second current electrode of transistor 23 is coupled to a first current electrode of p-channel transistor 25. A control electrode of transistor 25 is coupled to the second power supply voltage, and a second current electrode of transistor 25 is coupled to node 28. Node 28 is also coupled to a second current electrode of transistor 22, to a second terminal of capacitive element 26, and to a second current electrode of transistor 24.

Referring to FIG. 1, circuit 10 is operated so that the current through transistors 20, 21, 22, 23, and 25 are all approximately equal. Since transistor 23 is larger areawise then transistor 22, transistor 23 will have a smaller Vgs than transistor 22. This is done so that a deltaVgs is developed between transistors 22 and 23. Note that for the same current, the Vgs of transistor 22 will be larger then the Vgs of transistor 23. As used herein, deltaVgs will represent the difference in the gate to source voltage of transistor 22 as compared to the gate to source voltage of transistor 23. The deltaVgs will also be the voltage across transistor 25. The area of transistor 25 may be adjusted so that the current through transistor 25 is approximately the same as the current through transistors 20, 21, 22, and 23.

The voltage across transistor 21 (hereinafter V21) will be approximately equal to (deltaVgs/channel resistance of transistor 25)*(channel resistance of transistor 21). Note that V21+(Vgs of transistor 24) is approximately equal to the voltage between Vbattery and the voltage at node 28. The voltage between Vbattery and the voltage at node 28 (hereinafter Vdrop) is approximately equal to the bandgap voltage of the semiconductor material used to fabricate circuit 10. For silicon, the bandgap voltage is approximately 1.1 volts. Thus Vdrop for a circuit 10 formed in silicon is approximately 1.1 volts. Note that the Vdrop may be intentionally varied from the bandgap voltage in order adjust the behavior of circuit 10 due to the characteristics of the manufacturing process used to form circuit 10 and due to the desired voltage and temperature characteristics of circuit 10. Note also that Vdrop is the voltage drop across transistor 24.

Circuit 10 thus produces a voltage drop (Vdrop) between Vbattery and circuitry 27. This is very useful for application where the safe operating voltage for circuitry 27 is below the Vbattery voltage. For example, many smart card applications and handheld games use an inexpensive battery that may be one or more volts higher than the safe operating voltage of circuitry 27. Thus there is a need to use a circuit 10 which provides the desired amount of voltage drop between the power supply voltage (e.g. Vbattery) and the operating voltage of circuitry 27. Note that although the power supply voltage Vbattery has been illustrated as a battery voltage, alternate embodiments of the present invention may use any source for providing the power supply voltage. A battery is just one example of a possible power supply source. Circuitry 27 may be any type of circuitry which is capable of operating at a power supply voltage equal to or less than Vbattery. Note that for some embodiments, circuitry 27 may function at voltages higher than Vbattery, but a voltage of Vbattery or less at node 28 is used to power circuitry 27 in order to reduce the power used by circuitry 27 or in order to reduce the heat dissipated by circuitry 27.

In one embodiment of the present invention, a capacitor 26 is used to stabilize circuit 10. Note that if the voltage at the gate of transistor 24 were to decrease, then Vgs of transistor 24 would decrease. Then the voltage at node 28 would tend to increase (i.e. move toward Vbattery). As a result, transistor 23 would conduct less current, and thus less current would flow through transistor 21. Consequently, the voltage at the gate of transistor 24 will now be increased. Thus the voltage at the gate of transistor 24 may oscillate or dampen slowly if the phase through transistors 23, 24, and 25 increases toward 180 degrees. This oscillation of the voltage at the gate of transistor 24 is generally undesirable, and may be particularly apparent at higher frequencies (such as, for example, above 1 megahertz). Note that circuit 10 is generally intended to operate at frequencies below 1 megahertz down to DC (direct current). Alternate embodiments of the present invention may not use a capacitor 26. Other embodiments of the present invention may use alternate approaches and circuit elements to stabilize the operation of circuit 10.

Note that for one embodiment of the circuit 10 illustrated in FIG. 1, transistor 22, 23, and 24 operate in the subthreshold range where the gate to source voltage is below the threshold voltage of the transistor. Note that the threshold voltage (Vt) of the transistor is the voltage at which the transistor is considered to "turn on" and become conductive. In one embodiment, transistors 20 and 21 are not operated in the subthreshold range; however, alternate embodiments may operate transistors 20 and 21 in the subthreshold range. Note that operating a field effect transistor (e.g. 22, 23, 24) in the subthreshold range causes the gate to source voltage of the field effect transistor to behave in a similar manner to the base to emitter voltage of a bipolar transistor.

Note that it is often desirable to keep the voltage at node 28 relatively constant over a broad range of temperatures. Thus, it is desirable to keep Vdrop 28 relatively constant over a broad range of temperatures. In one embodiment, this is achieved by allowing a first portion of circuit 10 to have a positive temperature coefficient while a second portion of circuit 10 has a negative temperature coefficient. For one embodiment of circuit 10, the gate to source voltage of transistor 24 has a negative temperature coefficient (i.e. the Vgs of transistor 24 decreases as temperature increases). To offset this, the source to drain voltage of transistor 21 has a positive temperature coefficient (i.e. the Vsd of transistor 21 increases as temperature increases). The difference between the gate to source voltage of transistors 22 and 23 (deltaVgs) is approximately equal to (KT/q)*ln(area of transistor 23/area of transistor 22), where T is temperature in degrees Kelvin and K and q are known constants. Note that the positive temperature coefficient of Vsd of transistor 21 is a function of the deltaVgs between transistor 23 and 22. Thus, the combination of the negative and positive temperature coefficients offset each other and the net effect to circuit 10 is stability over temperature.

The area ratios of transistors 22 and 23, the area ratios of transistors 21 and 25, and the area of transistor 24 may be adjusted to in order to achieve a voltage drop (Vdrop) from node 30 to node 28 which is in a desired range. This desired range is usually centered around a bandgap voltage (1.1 volts for silicon). Alternate embodiments of the present invention may use any desired range for Vdrop, including voltages significantly more or less than the bandgap voltage. Thus, by varying the area ratios of transistors 22 and 23, the area ratios of transistors 21 and 25, and the area of transistor 24, the behavior of circuit 10 in regard to temperature may be varied.

Note that for one embodiment of the present invention, transistor 25 functions to provide impedance for circuit 10. Transistors 20 and 21 each function as a current source for circuit 10. Transistor 24 functions as an output transistor which may provide a significant amount of current to circuitry 27 when circuitry 27 is drawing higher amounts of current. The voltage at the gate of transistor 24 may be called a reference voltage. Regulator circuit 11 and output transistor 24 together form a voltage regulating circuit 10. Regulator circuit 11 includes transistors 20, 21, 22, 23, and 25, as well as capacitive element 26. The voltage at the control electrode of transistor 24 is labeled Vref and provides a reference voltage for output transistor 24.

Figure 2:
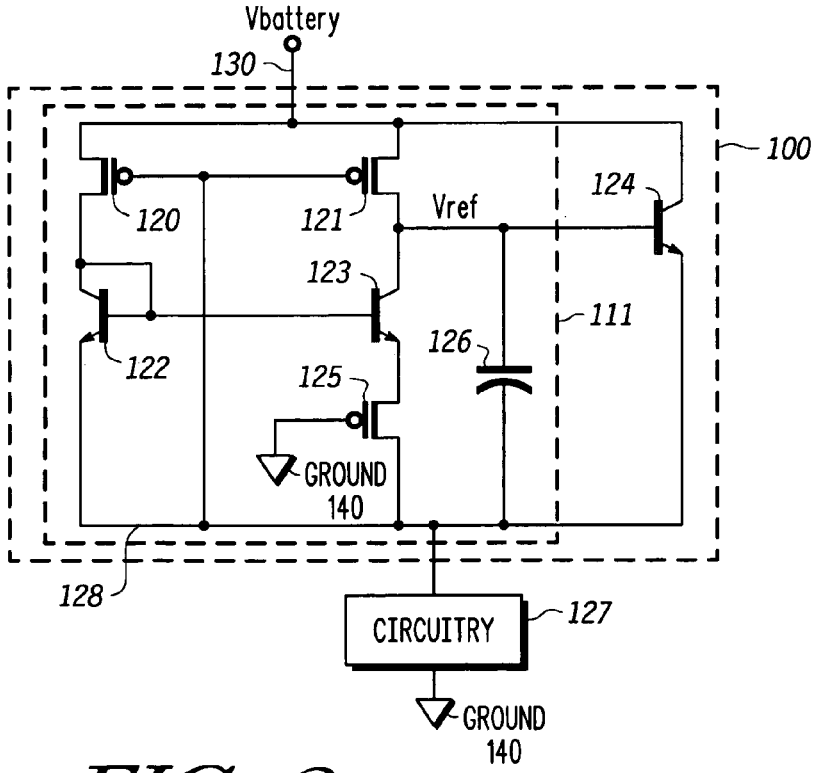
FIG. 2 illustrates, in schematic diagram form, a circuit in accordance with an alternate embodiment of the present invention.

FIG. 2 illustrates, in schematic diagram form, a circuit 100 in accordance with an alternate embodiment of the present invention. A first terminal of circuit 100 is coupled to node 130 and a second terminal of circuit 100 is coupled to node 128. A first power supply voltage (e.g. Vbattery) is coupled to node 130 and circuitry 127 is coupled to node 128. Circuitry 127 is also coupled to a second power supply voltage 40 (e.g. ground). A first current electrode of p-channel transistor 120, a first current electrode of p-channel transistor 121, and a first current electrode of bipolar transistor 124 are all coupled to node 130. A control electrode of transistor 120 and a control electrode of transistor 121 are both coupled to node 128. A second current electrode of transistor 120 is coupled to a first current electrode of bipolar transistor 122, to a control electrode of transistor 122, and to a control electrode of bipolar transistor 123. A second current electrode of transistor 121 is coupled to a first current electrode of transistor 123, to a control electrode of bipolar transistor 124, and to a first terminal of a capacitive element 126. A second current electrode of transistor 123 is coupled to a first current electrode of p-channel transistor 125. A control electrode of transistor 125 is coupled to the second power supply voltage, and a second current electrode of transistor 125 is coupled to node 128. Node 128 is also coupled to a second current electrode of transistor 122, to a second terminal of capacitive element 126, and to a second current electrode of transistor 124.

Note that for one embodiment of the present invention, transistor 125 functions to provide impedance for circuit 100. Transistors 120 and 121 each function as a current source for circuit 100. Transistor 124 functions as an output transistor which may provide a significant amount of current to circuitry 127 when circuitry 127 is drawing higher amounts of current. The voltage at the gate of transistor 124 may be called a reference voltage. Regulator circuit 111 and output transistor 124 together form a voltage regulating circuit 100. Regulator circuit 111 includes transistors 120, 121, 122, 123, and 125, as well as capacitive element 126. The voltage at the control electrode of transistor 124 is labeled Vref and provides a reference voltage for output transistor 124.

Referring to FIGS. 1 and 2, note that for one embodiment, circuit 100 is different from circuit 10 in that the field effect transistors 22, 23, and 24 of circuit 10 have been replaced with bipolar transistors 122, 123, and 124. For one embodiment of the present invention, bipolar transistors 122–125 may be implemented as npn bipolar transistors. Alternate embodiments of the present invention may alternately used p-channel transistors instead of selected n-channel transistors, use n-channel transistors for selected p-channel transistors, and/or use pnp bipolar transistors for selected of npn bipolar transistors. Note that for some embodiments of the present invention, circuit 10 may be used between circuitry 27 and the second power supply voltage 40, 140 (e.g. ground). Circuit 100 of FIG. 2 operates in a similar manner to circuit 10 of FIG. 1, where the bipolar transistors 122–124 operate as normal npn bipolar transistors. Note that the Vbe of bipolar transistors 122–124 behave similarly to the subthreshold behavior of the Vgs of field effect transistors 22–24 of FIG. 1.

Figure 3:
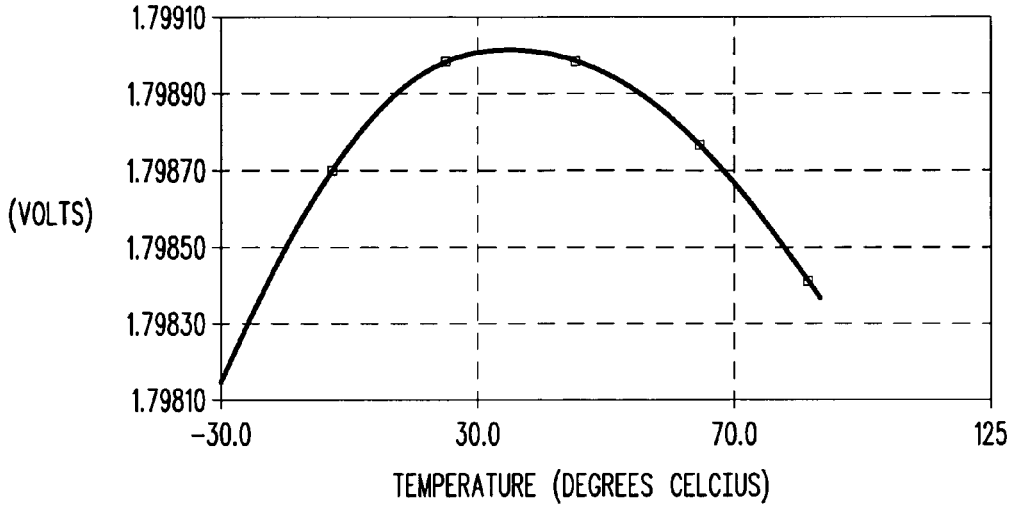
FIG. 3 illustrates, in graphical form, a voltage versus temperature curve for the circuit of FIG. 1 in accordance with one embodiment of the present invention.

FIG. 3 illustrates, in graphical form, a voltage versus temperature curve (assuming no variation in manufacturing process parameters) for the circuit of FIG. 1 in accordance with one embodiment of the present invention. The voltage illustrated is the voltage at node 28 (see FIG. 1) with respect to the second power supply voltage (e.g. ground). Note that voltage does not vary significantly (for the illustrated graph, approximately 1 millivolt) over a very wide temperature range (i.e. −30 degrees Celsius to 125 degrees Celsius). Alternate embodiments may vary the parameters of circuit 10 (e.g. sizes of the transistors, manufacturing process parameters) in order to change the voltage range of node 28 across whatever temperature range is desired.

Figure 4:
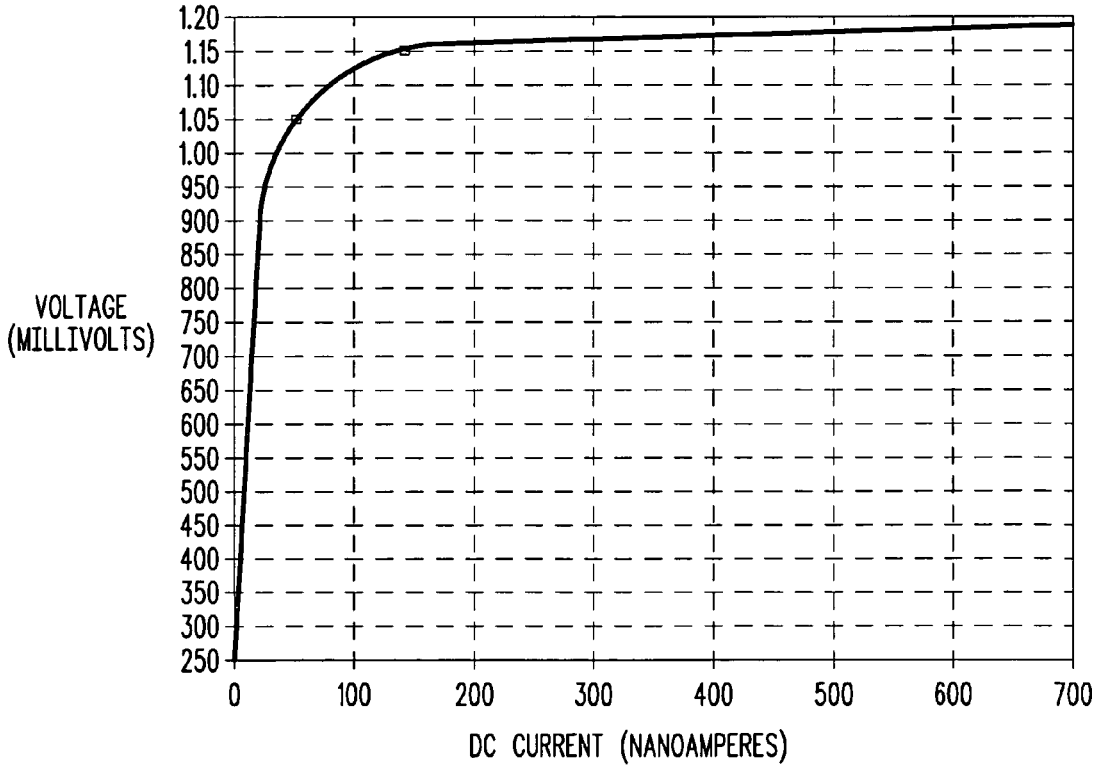
FIG. 4 illustrates, in graphical form, a voltage versus current curve for the circuit of FIG. 1 in accordance with one embodiment of the present invention.

FIG. 4 illustrates, in graphical form, a voltage versus current curve for the circuit of FIG. 1 in accordance with one embodiment of the present invention. The voltage illustrated is the voltage drop Vdrop from node 30 to node 28 (see FIG. 1). The current illustrated is the current provided from circuit 10 to circuitry 27. Note that Vdrop is fairly well established and does not significantly change once a current level of 150 nanoamperes has been reached. Thus circuit 10 provides a stable voltage drop between the first power supply voltage (Vbattery) and the voltage provided to circuitry 27 at node 28.

Figure 5:
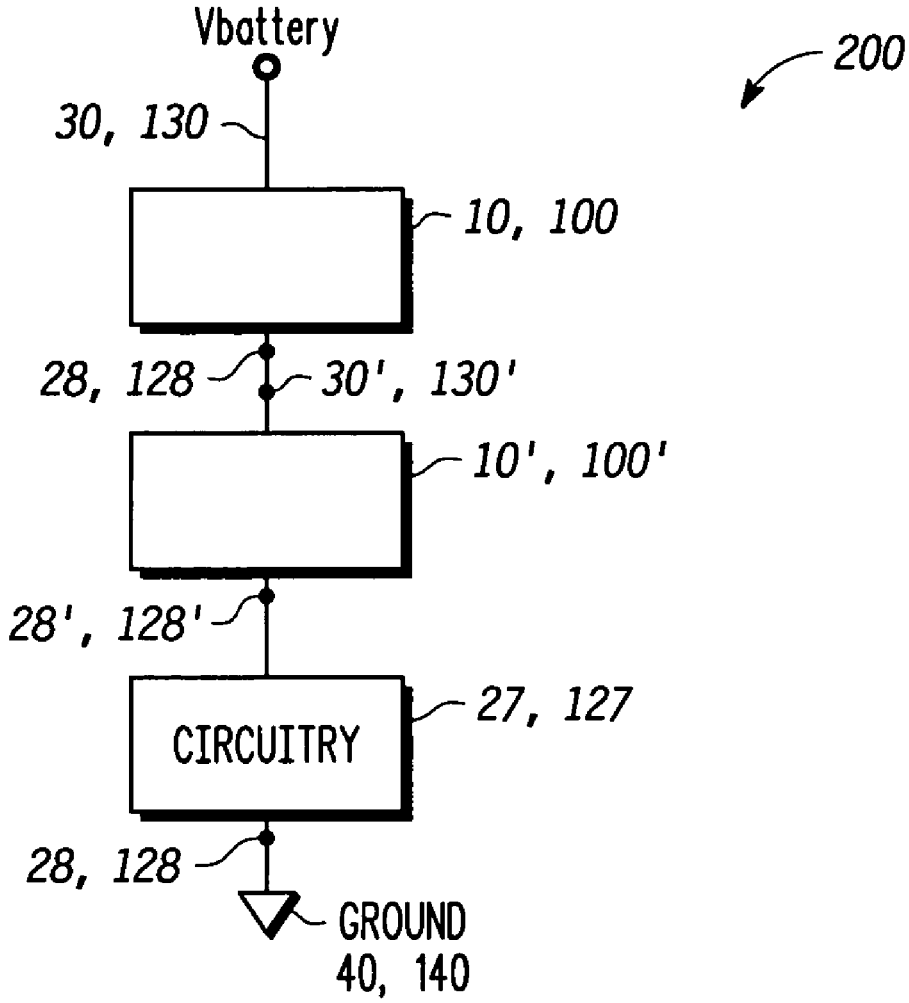
FIG. 5 illustrates, in block diagram form, a circuit in accordance with one embodiment of the present invention.

FIG. 5 illustrates, in block diagram form, a circuit 200 in accordance with one embodiment of the present invention. Note that a plurality of circuits 10 or circuits 100 may be placed in series in order to provide a larger voltage drop between the first power supply voltage (Vbattery) 30, 130 and circuitry 27, 127. Any number of circuits 10, 100 may be placed in series. Any combination of circuits 10 and 100 may also be used in series. Note that reference numbers 10', 30', and 28' represent a second instantiation of circuit 10 or FIG. 1. Note that reference numbers 100', 130', and 128' represent a second instantiation of circuit 100 of FIG. 2. Also, alternate embodiments may move the plurality of instantiations of circuits 10, 100 to be located between circuitry 27, 127 and the second power supply voltage 40, 140 (e.g. ground).

Although the invention has been described with respect to specific conductivity types or polarity of potentials, skilled artisans appreciated that conductivity types and polarities of potentials may be reversed.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A circuit having a first output terminal, comprising:

a first current source having an input coupled to a power supply terminal, and an output;

a second current source having an input coupled to the power supply terminal, and an output;

a first transistor having a first current electrode and a control electrode coupled to the output of the first current source, and a second current electrode coupled to the first output terminal;

a second transistor having a first current electrode coupled to the output of the second current source, a control electrode coupled to the control electrode of the first transistor, and a second current electrode;

an impedance having a first terminal coupled to the second current electrode of the second transistor and a second terminal coupled to the first output terminal; and a third transistor having a first current electrode coupled to the power supply terminal, a control electrode coupled to the first current electrode of the second transistor, and a second current electrode coupled to the first output terminal, wherein the first output terminal is not connected to a negative rail.

2. The circuit of claim 1, wherein the first, second, and third transistors are MOS transistors.

3. The circuit of claim 2, wherein the first, second, and third transistors are N channel transistors.

4. The circuit of claim 1, wherein the first, second, and third transistors are bipolar transistors.

5. The circuit of claim 4, wherein the bipolar transistors are NPN transistors.

6. The circuit of claim 1, wherein the first and second current sources are MOS transistors.

7. The circuit of claim 1, wherein a voltage provided at the first output terminal can be varied significantly when a voltage provided at the power supply terminal is not varied significantly.

8. The circuit of claim 1, wherein the first and second current sources are further characterized as responding to a reduction in voltage on the first output terminal by supplying more current.

9. The circuit of claim 1, wherein the impedance comprises an MOS transistor.

10. The circuit of claim 9, wherein the MOS transistor has a first current electrode as the first terminal coupled to the second current electrode of the second transistor, a second current electrode as the second terminal coupled to the first output terminal, and a gate coupled to a ground terminal.

11. The circuit of claim 1, further comprising a capacitive element having a first terminal coupled to the control electrode of the third transistor and a second terminal coupled to the first output terminal.

12. The circuit of claim 1 having a second output terminal further comprising:

a third current source having an input coupled to the first output terminal, and an output;

a fourth current source having an input coupled to the first output terminal, and an output;

a fourth transistor having a first current electrode and a control electrode coupled to the output of the third current source, and a second current electrode coupled to the second output terminal;

a fifth transistor having a first current electrode coupled to the output of the fourth current source, a control electrode coupled to the control electrode of the fourth transistor, and a second current electrode;

a second impedance having a first terminal coupled to the second current electrode of the fifth transistor and a second terminal coupled to the second output terminal; and a sixth transistor having a first current electrode coupled the first output terminal, a control electrode coupled to the first current electrode of the fourth transistor, and a second cuirent electrode coupled to the second output terminal.

13. A circuit having a first output terminal, comprising:

a regulator circuit coupled between a positive power supply terminal and the first output terminal for providing a reference voltage; and an output transistor having a first current electrode coupled to the positive power supply terminal, a control electrode for receiving the reference voltage, and a second current electrode coupled to the first output terminal;

wherein a voltage of the first output terminal exceeds a negative rail during operation of the circuit.

14. The circuit of claim 13, wherein the regulator comprises:

a pair of current sources that each provide equal currents.

15. The circuit of claim 14, wherein all of the current received by the regulator circuit passes to the first output terminal.

16. The circuit of claim 13, wherein the regulator increases the reference voltage in response to a decrease in voltage at the first output terminal.

17. The circuit of claim 13, wherein the regulator comprises:

a first current source having an input coupled to a power supply terminal, and an output;

a second current source having an input coupled to the power supply terminal, and an output;

a first transistor having a first current electrode and a control electrode coupled to the output of the first current source, and a second current electrode coupled to the first output terminal;

a second transistor having a first current electrode coupled to the output of the second current source for providing the reference voltage, a control electrode coupled to the control electrode of the first transistor, and a second current electrode; and an impedance having a first terminal coupled to the second current electrode of the second transistor and a second terminal coupled to the first output terminal.

18. The circuit of claim 13 having a second output terminal, further comprising:

a second regulator circuit coupled between the first output terminal and the second output terminal for providing a second reference voltage; and a second output transistor having a first current electrode coupled to the first output terminal, a control electrode for receiving the second reference voltage, and a second current electrode coupled to the second output terminal;

wherein all of the current received by the second regulator circuit passes to the second output terminal.

19. A circuit having a first output terminal, comprising:

a current mirror for establishing a reference current for establishing a reference voltage, wherein the reference current increases in response to a decrease in voltage at the output terminal;

an impedance that carries the reference current and that decreases in magnitude with increases in temperature; and an output transistor for receiving the reference voltage and providing an output current at the output terminals, wherein the voltage at the output terminal exceeds a negative rail voltage during operation of the circuit.

20. The circuit of claim 19, wherein the current mirror comprises:

a first current source having an input coupled to a power supply terminal, and an output;

a second current source having an input coupled to the power supply terminal, and an output;

a first transistor having a first current electrode and a control electrode coupled to the output of the first current source, and a second current electrode coupled to the first output terminal; and a second transistor having a first current electrode coupled to the output of the second current source for providing the reference voltage, a control electrode coupled to the control electrode of the first transistor, and a second current electrode coupled to the impedance.

21. The circuit of claim 19 having a second output terminal, further comprising:

a second current mirror for establishing a second reference current for establishing a second reference voltage, wherein the second reference current increases in response to a decrease in voltage at the second output terminal;

a second impedance that carries the second reference current and that decreases in magnitude with increases in temperature; and a second output transistor for receiving the second reference voltage and providing a second output current at the second output terminal.

* * * * *